US010534318B2

(12) United States Patent
Masone

(10) Patent No.: US 10,534,318 B2
(45) Date of Patent: Jan. 14, 2020

(54) PUSH IN WATCH CROWN MECHANISM

(71) Applicant: Kevin Joseph Masone, Yorba Linda, CA (US)

(72) Inventor: Kevin Joseph Masone, Yorba Linda, CA (US)

( * ) Notice: Subject to any disclaimer, the term of this patent is extended or adjusted under 35 U.S.C. 154(b) by 129 days.

(21) Appl. No.: 15/925,665

(22) Filed: Mar. 19, 2018

(65) Prior Publication Data

US 2018/0210397 A1 Jul. 26, 2018

Related U.S. Application Data

(63) Continuation-in-part of application No. 15/296,043, filed on Oct. 18, 2016, now abandoned.

(60) Provisional application No. 62/330,149, filed on May 1, 2016.

(51) Int. Cl.
*G04B 3/04* (2006.01)
*G04B 27/02* (2006.01)

(52) U.S. Cl.
CPC ..... *G04B 3/043* (2013.01); *G04B 27/02* (2013.01); *G04B 3/041* (2013.01)

(58) Field of Classification Search
CPC ..... G04B 3/041; G04B 3/043; G04B 27/02
See application file for complete search history.

(56) References Cited

U.S. PATENT DOCUMENTS 4,364,674 A * 12/1982 Tesch ..... G04B 37/106 368/308
4,620,798 A * 11/1986 Scarinzi ..... G04B 37/0058 368/276
5,253,227 A * 10/1993 Wong ..... G04B 27/002 368/185
6,203,189 B1 * 3/2001 Schafer ..... G04B 37/106 368/320
8,092,077 B2 * 1/2012 Hobor ..... G04B 3/045 368/308
9,268,306 B2 * 2/2016 Briswalter ..... G04B 37/106
2005/0249051 A1 * 11/2005 Cogoli ..... G04B 3/04 368/319
2007/0091727 A1 * 4/2007 Bonvin ..... G04F 3/022 368/107
2011/0044140 A1 * 2/2011 Marti ..... G04B 3/045 368/185
2018/0046145 A1 * 2/2018 Kissling ..... G04B 19/283

* cited by examiner

*Primary Examiner* — Edwin A. Leon
*Assistant Examiner* — Jason M Collins

(57) ABSTRACT

Push-in watch crown mechanisms and methods are described. The push-in watch crown mechanisms include a locking mechanism for latching the watch crown inside the watch body such that the top of the watch crown is substantially flush to the edge of the watch body. Further, the push-in watch crown mechanisms include a release mechanism for unlatching the watch crown so that it is released outside of the watch body and accessible for use. Additionally, methods of using push-in watch crown mechanisms are described.

26 Claims, 20 Drawing Sheets

PUSH IN WATCH CROWN MECHANISM

CROSS-REFERENCE TO RELATED APPLICATIONS

The presently disclosed subject matter is related to U.S. Patent Pub. No. 20170315508, entitled "Push In Watch Crown Mechanism," published on Nov. 2, 2017; the entire disclosure of which is incorporated herein by reference.

TECHNICAL FIELD

The presently disclosed subject matter relates generally to watch technology and more particularly to a push-in watch crown mechanisms and methods.

BACKGROUND

A watch crown is the knob on the outside of the body of the watch that is used to set the time of the watch and a variety of other functions. In a mechanical watch, the crown knob may be used to wind the mainspring. Standard watch crowns are located outside of the watch casing and protrude from the watch, which enables the user to grip and pull the crown to adjust the time and other features on the watch. To operate the watch crown, the user will pull the knob outward away from the watch to adjust the time, and then push the crown back towards the watch to set the time.

Generally, when a watch is worn on the left wrist, the watch crown protrudes from the right side of the watch. Similarly, when a watch is worn on the right wrist, the watch crown protrudes from the left side of the watch. This allows the user to easily access the watch crown with his/her opposite hand to adjust the time or other features of the watch. A drawback of standard watch crowns is that they can be uncomfortable. For example, standard watch crowns protrude from the watch body, which can cause discomfort and irritation because of the watch crown digging into the user's wrist or hand.

SUMMARY

Provided is a push-in watch crown mechanism in a watch, wherein the watch comprises a watch body comprising a watch body edge, and wherein the push-in watch mechanism comprises:

a watch crown;

a means by which the watch crown can be pushed inside the watch body and held substantially flush with the watch body edge; and a means by which the watch crown can be released from inside the watch body such that the watch crown is protruding outside of the watch body and accessible by a user;

wherein when the watch crown is pushed inside the watch body and held substantially flush with the watch body edge, the watch crown is substantially hidden from view and substantially smooth to the touch with respect to the watch body edge;

wherein the watch further comprises a watch movement and a watch stem; wherein the push-in watch crown mechanism is provided in relation to the watch body edge, the watch movement, and the watch stem;

wherein the push-in watch crown mechanism comprises a watch crown assembly in combination with a crown latching member, wherein the crown latching member comprises a rocker arm installed on a pin on which the rocker arm can pivot; and wherein the watch crown assembly comprises a watch crown, a sleeve, a collar, and a spring.

In some aspects, the push-in watch crown mechanism further comprises a release button provided on an end of the rocker arm that is oriented at the watch body edge, and comprising a latch tip provided on an end of the rocker arm that is oriented toward the sleeve of the watch crown assembly. In some aspects, in the watch crown assembly, one end of the sleeve is fitted to the inside of the watch crown, and wherein an opposite end of the sleeve has a tapered rim or lip configured to engage with the crown latching member. In some aspects, the collar is fitted inside the sleeve, and wherein the spring is fitted between the collar and the watch crown. In further aspects, the watch crown assembly is a spring-loaded mechanism. In further aspects, in the watch crown assembly, the collar is held fixed on the watch stem of the watch, and further the collar is set a certain distance from the watch body edge such that there is sufficient clearance to allow the watch crown to be either hidden inside the watch body edge or released to the outside of the watch body edge. In some aspects the sleeve is coupled to the inside of the watch crown, the sleeve is slideably coupled to the collar, and the sleeve and the watch crown are movable with respect to the collar.

In some aspects, the watch crown is configured to be pushed inside the watch body edge such that the rim or lip of the sleeve engages with the latch tip of the crown latching member, thereby holding the watch crown such that the top of the watch crown is substantially flush to the watch body edge and wherein the watch crown is substantially hidden from view and substantially smooth to the touch with respect to the watch body edge. In some aspects, the push-in watch crown mechanism is configured such that when the release button of the crown latching member is pushed, the latch tip of the crown latching member disengages from the rim or lip of the sleeve allowing the force of the spring to push the watch crown outside of the watch body edge, thereby allowing the watch crown to be accessible by the user. In some aspects, the watch crown is configured to be pulled out further to perform any functions of the watch.

Also provided is a method of using the push-in watch crown mechanism described above, comprising the steps of:

a. providing the push-in watch crown mechanism in the watch;

b. pushing the watch crown of the watch crown mechanism into the watch such that the the rim or lip of the sleeve engages with the latch tip of the crown latching member, thereby latching or locking the watch crown into a hidden state inside the watch body whereby the watch crown is held substantially flush with the the watch body edge;

c. pressing the release button of the crown latching member, thereby causing the latch tip of the crown latching member to release the rim or lip of the sleeve, whereby the watch crown is released from inside the watch body and made accessible outside the watch body edge.

Also provided is a push-in watch crown mechanism in a watch, wherein the watch comprises a watch body comprising a watch body edge, and wherein the push-in watch mechanism comprises:

a watch crown;

a means by which the watch crown can be pushed inside the watch body and held substantially flush with the watch body edge; and a means by which the watch crown can be released from inside the watch body such that the watch crown is protruding outside of the watch body and accessible by a user;

wherein when the watch crown is pushed inside the watch body and held substantially flush with the watch body edge, the watch crown is substantially hidden from view and substantially smooth to the touch with respect to the watch body edge;

wherein the watch further comprises a watch movement and a watch stem;

wherein the push-in watch crown mechanism is provided in relation to the watch body edge, the watch movement, and the watch stem; and wherein the push-in watch crown mechanism comprises a watch crown assembly in combination with a crown latching member; and further wherein the watch crown assembly comprises a watch crown, a housing, a collar, a spring, and a release mechanism.

In some aspects, the watch crown comprises a hollow sleeve portion that is integrated in one piece with the watch crown portion; a plurality of guide knobs is provided on the sleeve portion of the watch crown; and an arrangement of teeth is provided on the tip of the sleeve portion of the watch crown; further wherein the housing is a hollow tubular member that comprises an arrangement of internal slots for receiving guide features of the release mechanism; wherein the release mechanism comprises a wide portion and a narrow portion, wherein the narrow portion is oriented toward the sleeve portion of the watch crown; and wherein the guide knobs of the watch crown engage with the release mechanism at a transition area between the wide portion and the narrow portion. In some aspects, the collar is fitted inside the sleeve portion of the watch crown and the spring is fitted between the collar and the watch crown, whereby the watch crown assembly is a spring-loaded mechanism. In some aspects, the collar is held fixed on the watch stem of the watch and is set a certain distance from the watch body edge such that there is sufficient clearance to allow the watch crown to be either hidden inside the watch body edge or released to the outside of the watch body edge; the inside of the sleeve portion of the watch crown is slideably coupled to the collar, whereby the sleeve portion of the watch crown is movable with respect to the collar; and the sleeve portion of the watch crown is slideably coupled to the inside of the housing, whereby the guide knobs on the sleeve portion of the watch crown engage with the internal slots of the housing.

In other aspects, the narrow portion of the release mechanism is butted against the sleeve portion of the watch crown and the wide portion of the release mechanism is slideably coupled to the inside of the housing; the ends of the guide features of the release mechanism engage with the teeth on the tip of the sleeve portion of the watch crown; and the housing is held in a fixed position with respect to the body of the watch and the watch body edge.

In other aspects, the watch crown assembly provides an integrated toggling release mechanism wherein pushing on the watch crown a first time locks the watch crown inside the watch body and pushing on the watch crown a second time releases the watch crown; the release mechanism allows the watch crown to be released out of the watch case through the guidance of the internal slots of the housing; the release mechanism comes in contact with the collar; the spring is located inside the watch crown and in direct contact with the collar; and the watch crown is used to pull the collar, wherein the collar is fixed to the watch stem that engages the watch movement to set the time; and wherein by pushing the watch crown into the watch case, the internal slots of the housing locks the watch crown into the case, and whereby through the use of an additional manual push by the user, the watch crown is released through the use of the housing and the release mechanism.

In other aspects, the watch crown has external guide knobs that align to the internal slots of the housing; the housing remains in a fixed position relative to the watch case; the internal slots of the housing allow the watch crown to be guided inside the watch case, whereby some of the internal slots allow the watch crown to be pushed in and then locked inside, thereby producing locking internal slots, and whereby other internal slots allow the watch crown to be released outside the watch case, thereby producing releasing internal slots. In other aspects, the release mechanism is configured to allow the watch crown to be released out of the watch case via the external guide features; the release mechanism is free to rotate axially relative to the entire watch crown mechanism and to the watch stem; the guide features of the release mechanism are angled to match the profile of the teeth of the watch crown and thereby interlock the watch crown and the release mechanism, thereby turning the watch crown to lock into the locking internal slots of the housing or to turn the watch crown to release into the releasing internal slots of the housing, and whereby the release mechanism is configured to allow the watch crown to move from the locking internal slots to the releasing internal slots of the housing, or vice versa. In other aspects, at one end of the housing there is a small portion that has no internal slots, thereby providing a clearance region on which the guide knobs of the watch crown can ride, wherein the guide knobs are free to rotate axially about the watch stem.

Also provided is a method of using the push-in watch crown mechanism described above, comprising the steps of:

a. providing the push-in watch crown mechanism in the watch;

b. pushing the watch crown of the watch crown mechanism into the watch such that the guide knobs of the move to the locking internal slots of the housing, thereby latching or locking the watch crown into a hidden state inside the watch body whereby the watch crown is held substantially flush with the the watch body edge;

c. pressing the watch crown of the watch crown assembly, thereby causing the guide knobs of the watch crown to move from the locking internal slots to the releasing internal slots of the housing, whereby the watch crown is released from inside the watch body and made accessible outside the watch body edge.

Also provided is a push-in watch crown mechanism in a watch, wherein the watch comprises a watch body comprising a watch body edge, and wherein the push-in watch mechanism comprises:

a watch crown;

a means by which the watch crown can be pushed inside the watch body and held substantially flush with the watch body edge; and a means by which the watch crown can be released from inside the watch body such that the watch crown is protruding outside of the watch body and accessible by a user;

wherein when the watch crown is pushed inside the watch body and held substantially flush with the watch body edge, the watch crown is substantially hidden from view and substantially smooth to the touch with respect to the watch body edge;

wherein the watch further comprises a watch movement and a watch stem;

wherein the push-in watch crown mechanism is provided in relation to the watch body edge, the watch movement, and the watch stem; and wherein the push-in watch crown mechanism comprises a watch crown assembly in combination with a crown latching member; and further wherein the watch crown assembly comprises a watch crown, a housing, a collar, and a spring.

In some aspects, a substantially continuous slot is provided in ring-fashion around the inner surface of the housing, wherein the slot is configured to receive and guide the guide knobs of the watch crown. In some aspects, the slot is configured to receive and guide the guide knobs of the watch crown through a locking and releasing cycle wherein:

a. the guide knobs slide into one of the entry/exit portions of the slot;

b. the guide knobs slide into the locking portions of the slot, wherein when the guide knobs are in the locking pockets, the watch crown is in the hidden or pushed-in state;

c. the guide knobs slide into the releasing portions of the slot; and d. the guide knobs slide out of the next entry/exit portion of the slot.

In some aspects, the push-in watch crown mechanism is configured such that each time a user pushes the watch crown, the guide knobs of the watch crown walk around the slot and the watch crown alternates between locked and released, and further wherein the curves in the slot facilitate the movement of the guide knobs along the slot. In some aspects, at one end of the housing there is a small portion that is free of the slot, thereby providing a clearance region on which the guide knobs of the watch crown can ride, wherein the guide knobs are free to rotate axially about the watch stem.

BRIEF DESCRIPTION OF THE DRAWINGS

Figure 1A:
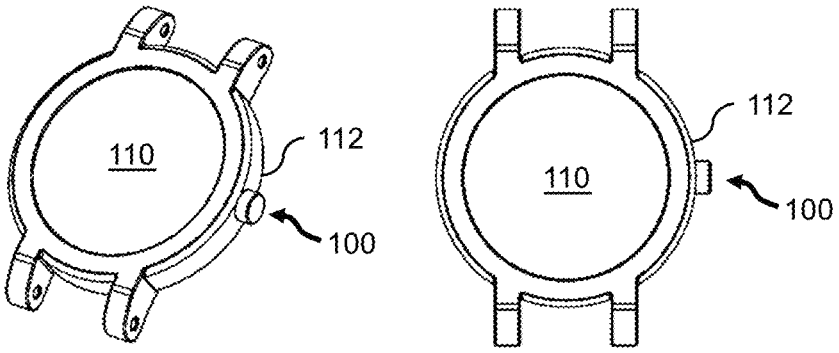
Figure 1B:
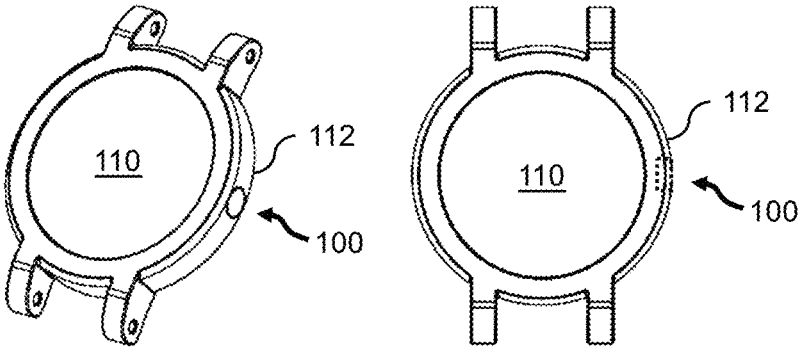
Figure 2:
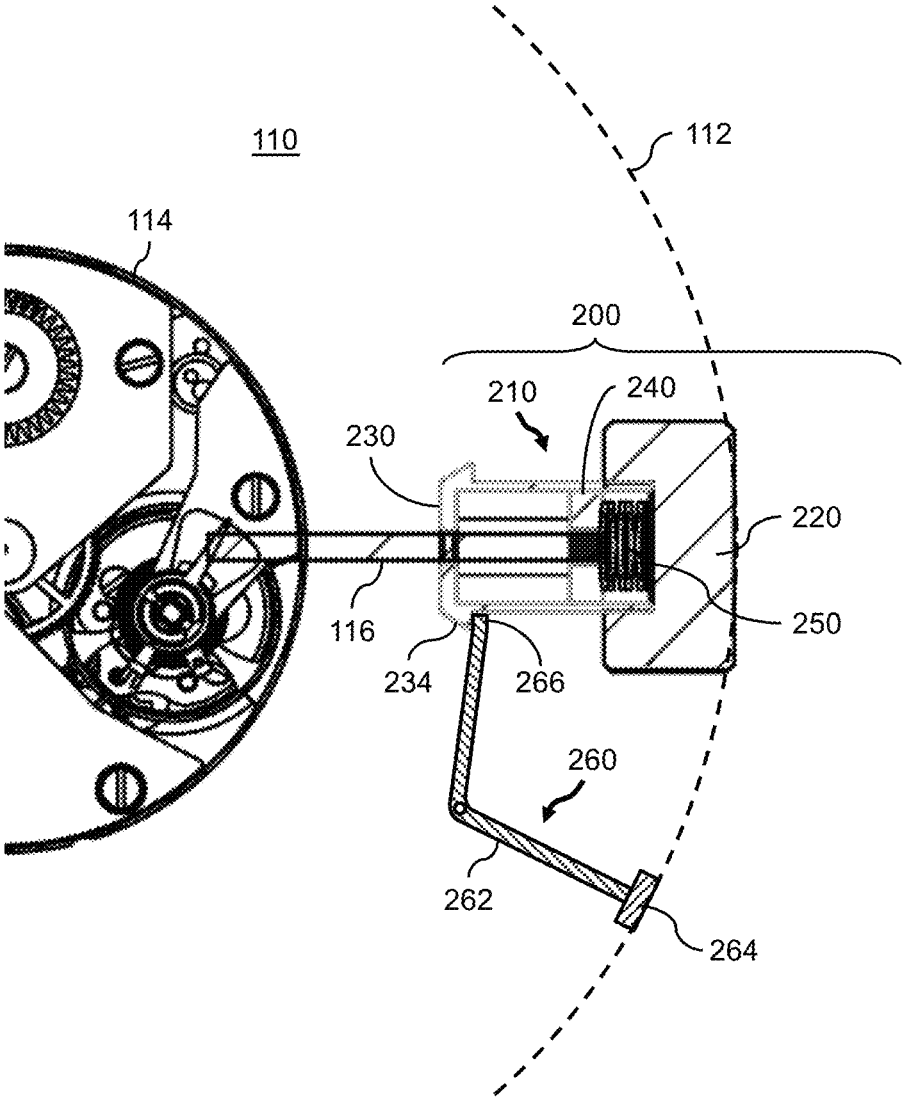
Figure 3:
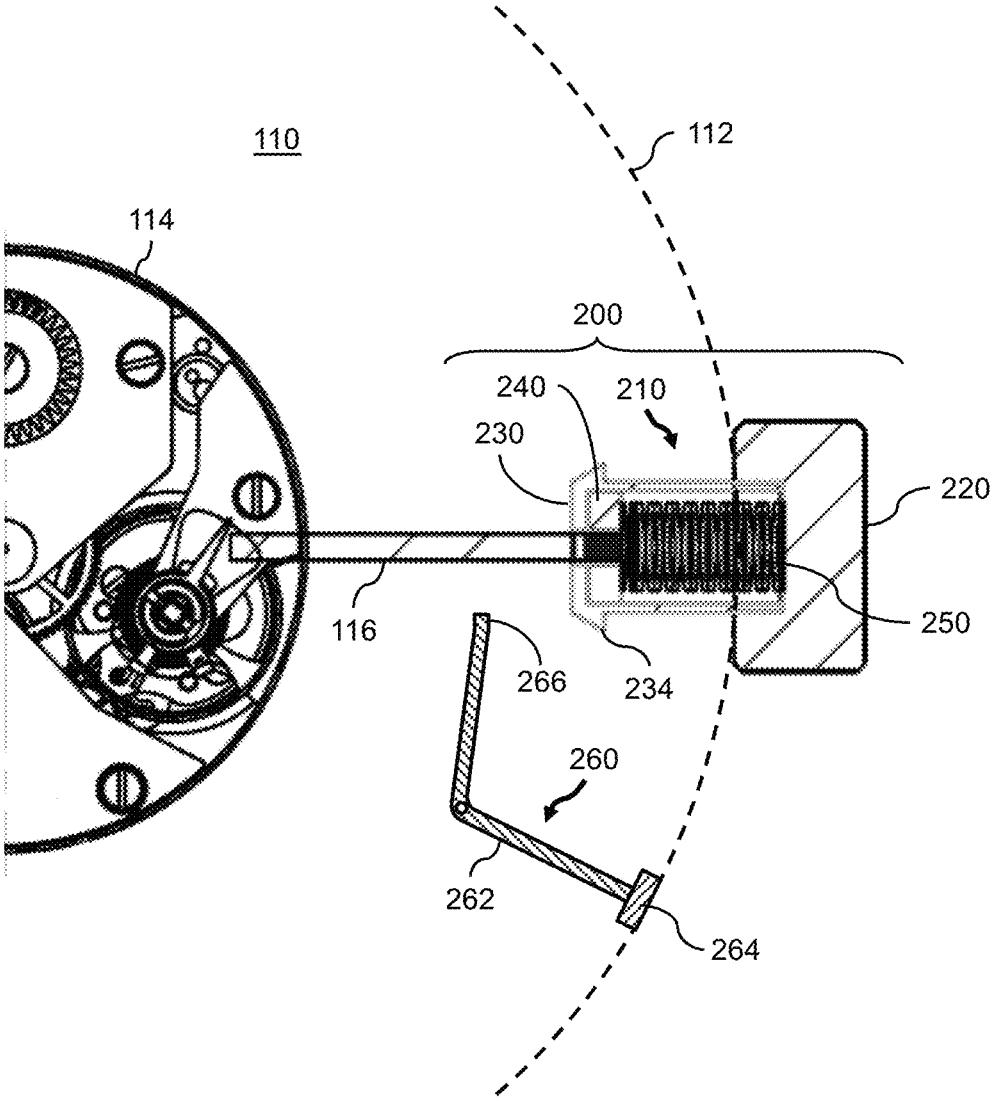
Figure 4:
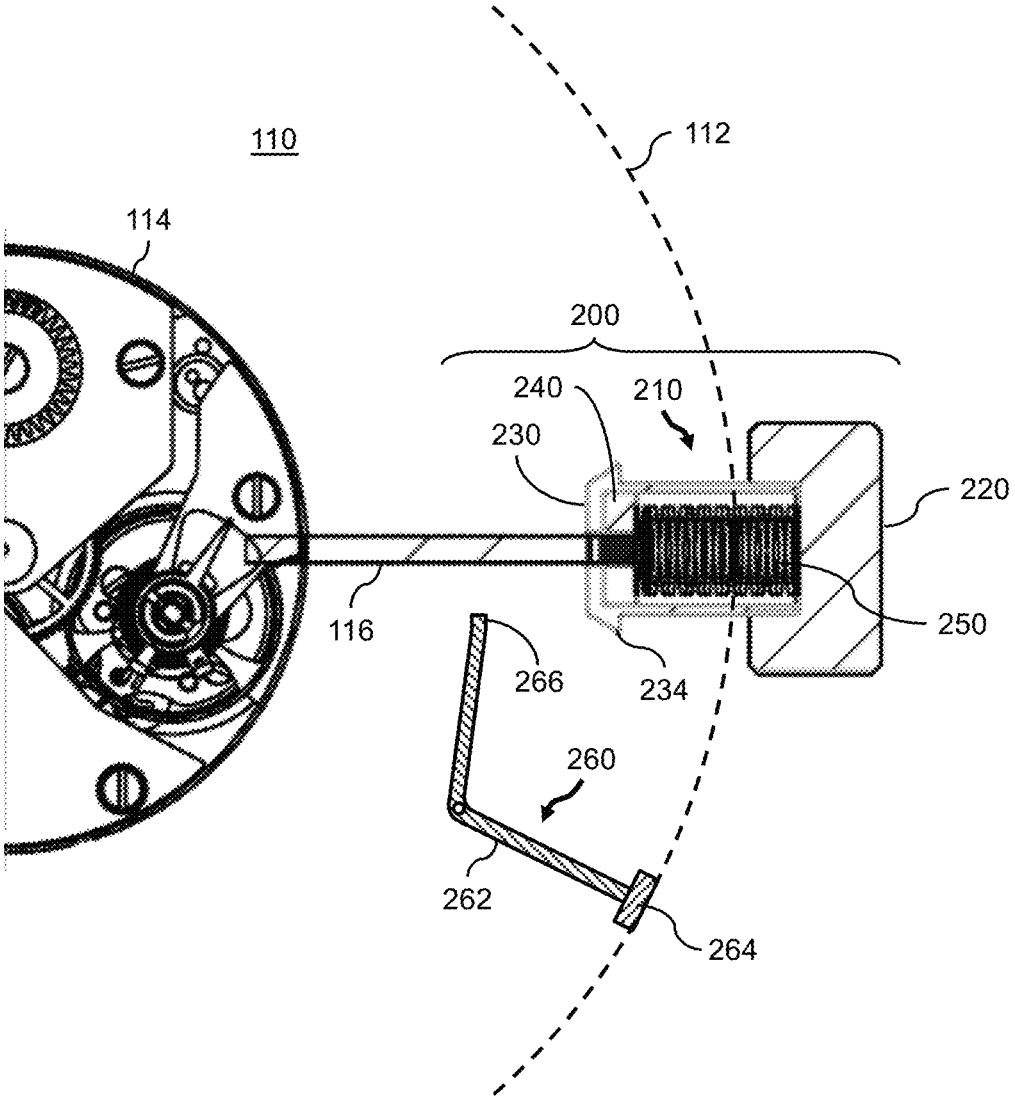
Figure 5A:
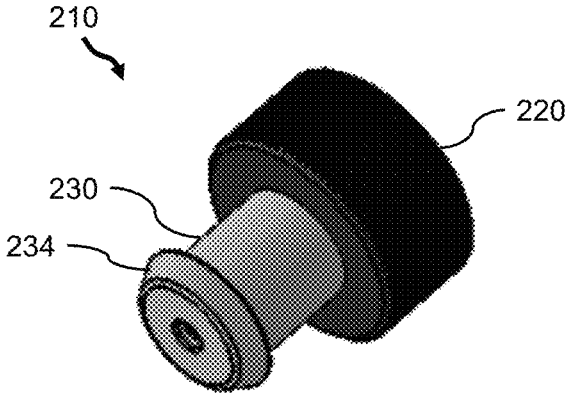
Figure 5B:
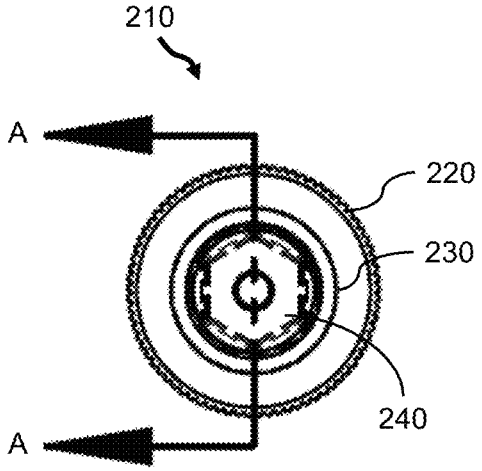
Figure 5C:
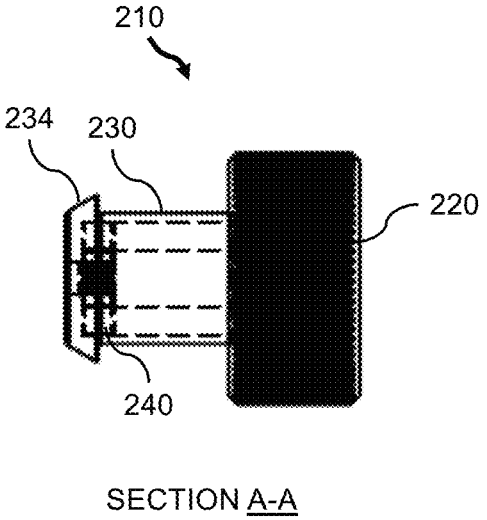
Figure 6A:
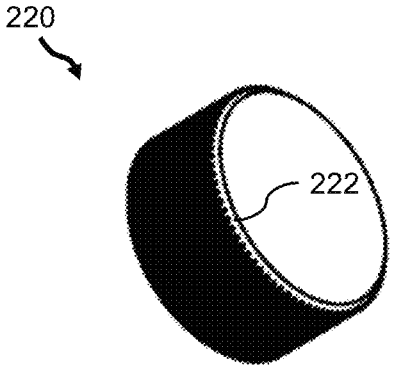
Figure 6B:
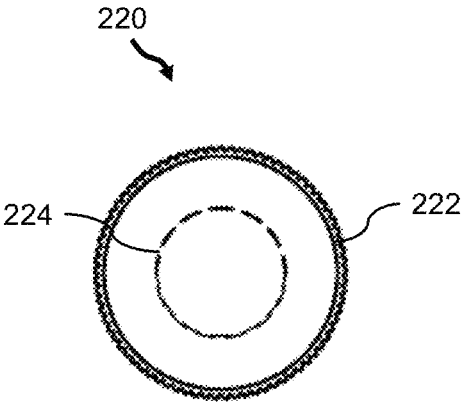
Figure 6C:
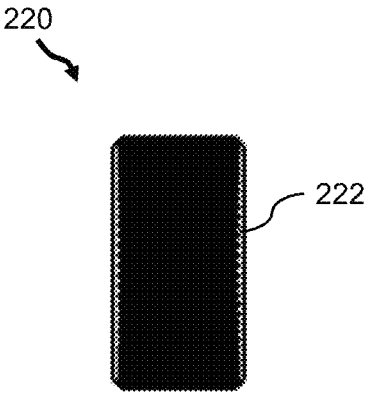
Figure 7A:
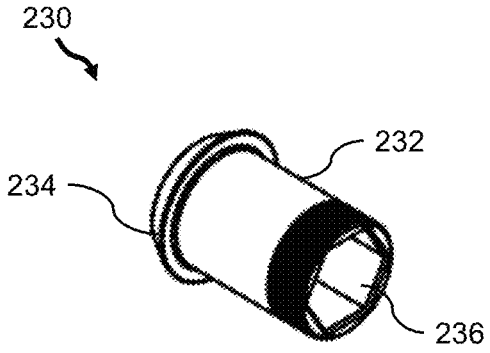
Figure 7B:
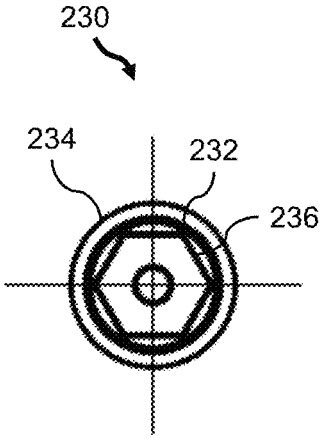
Figure 7C:
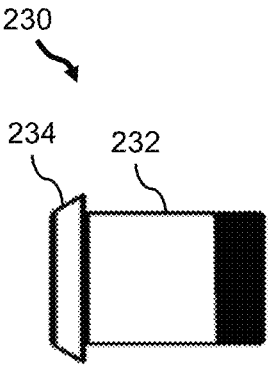
Figure 8A:
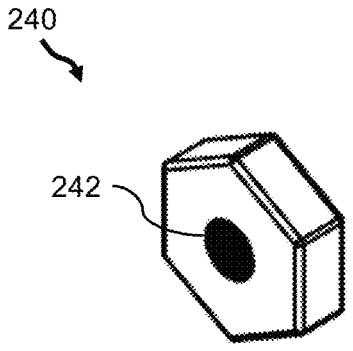
Figure 8B:
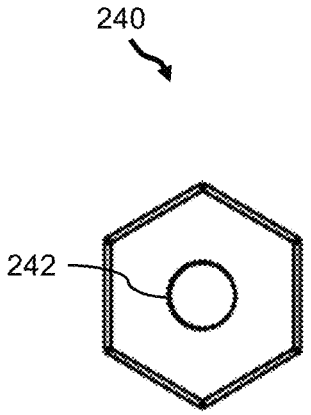
Figure 8C:
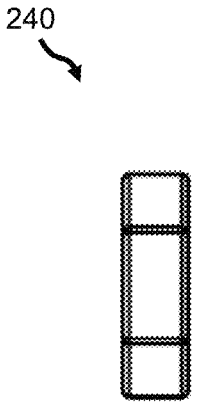
Figure 9:
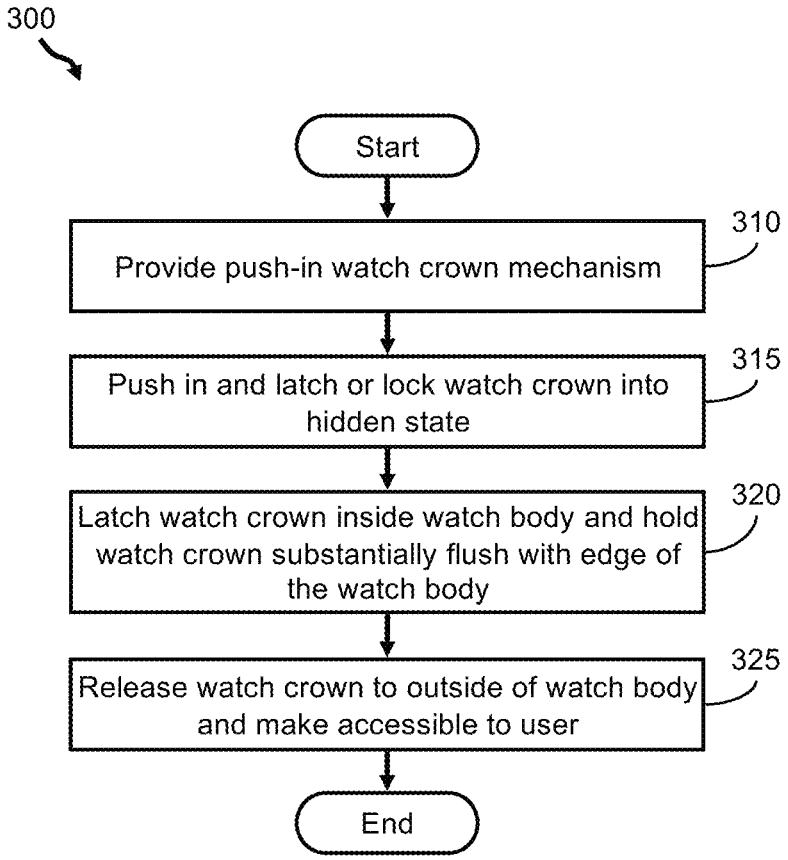
Figure 10:
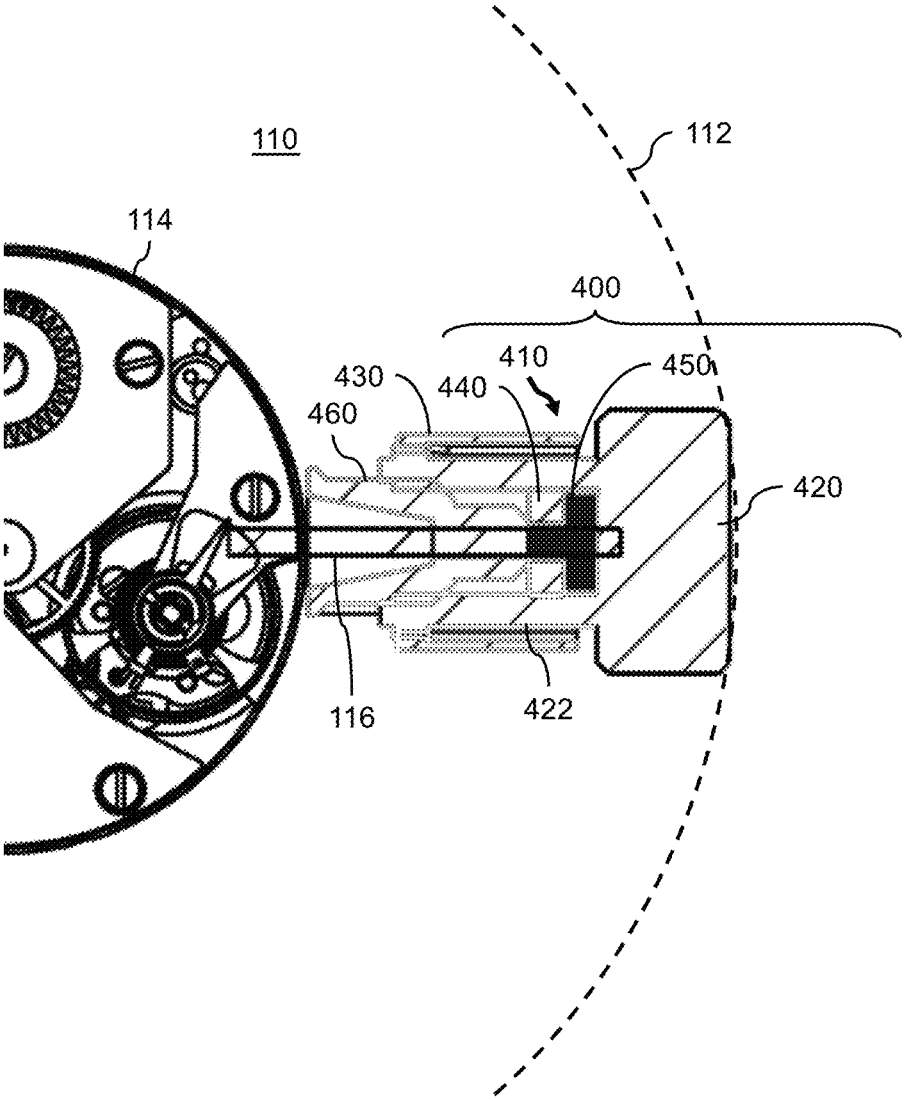
Figure 11:
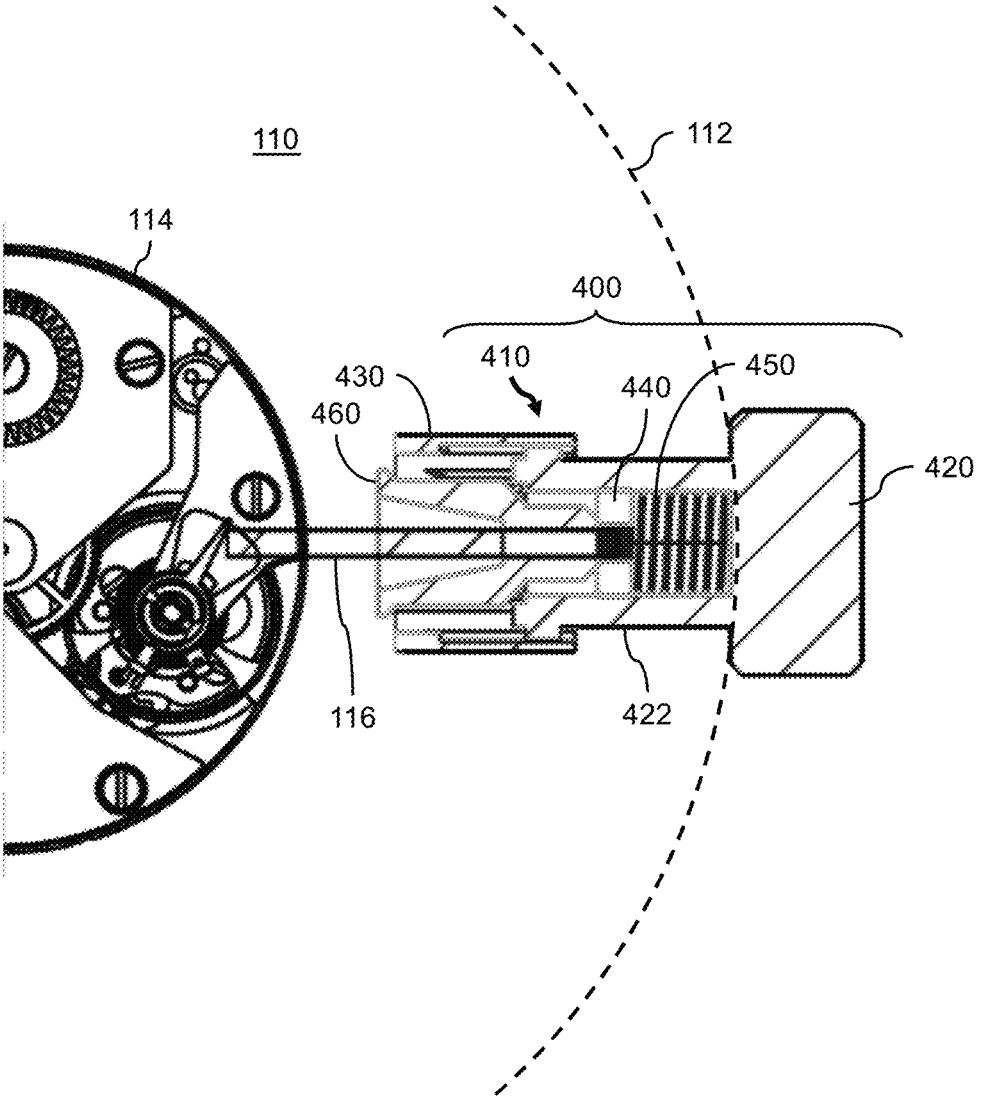
Figure 12:
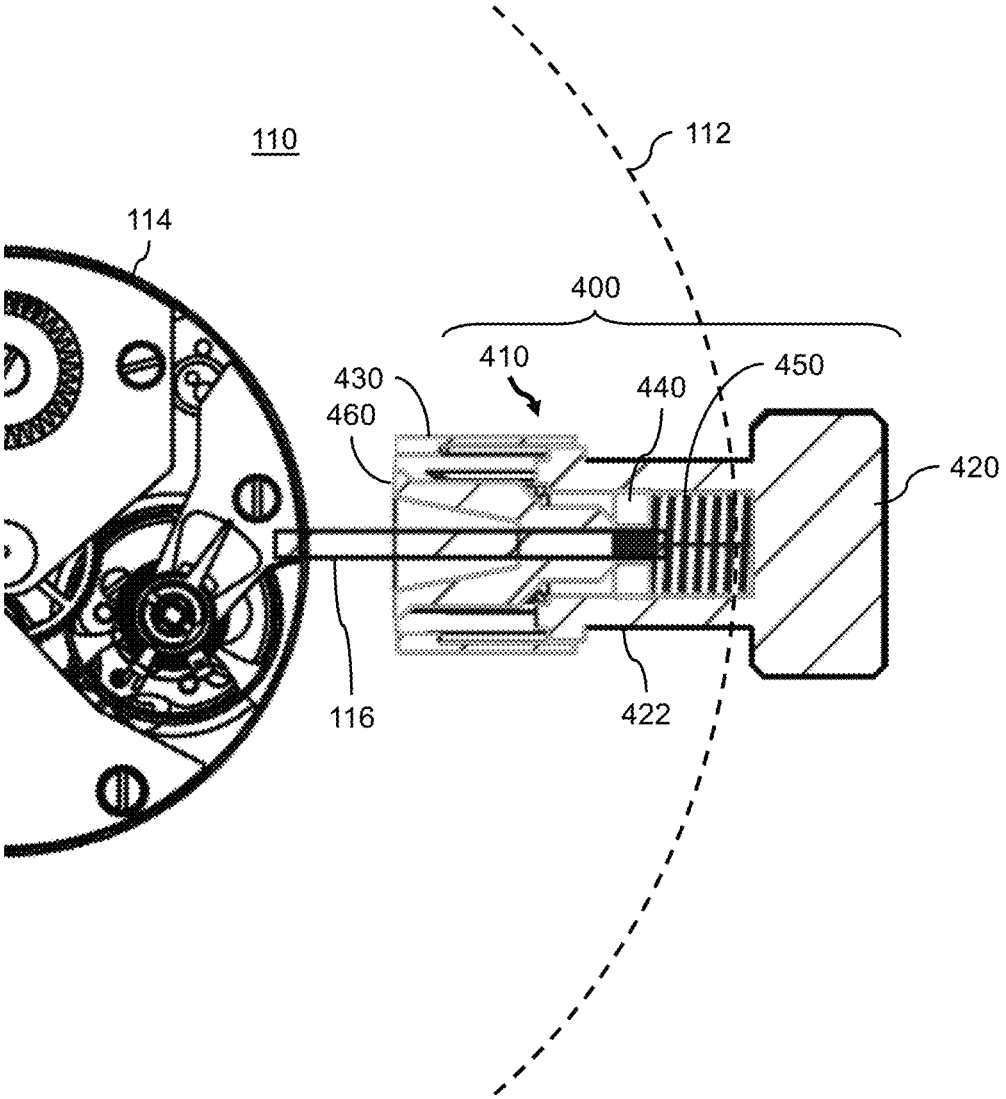
Figure 13:
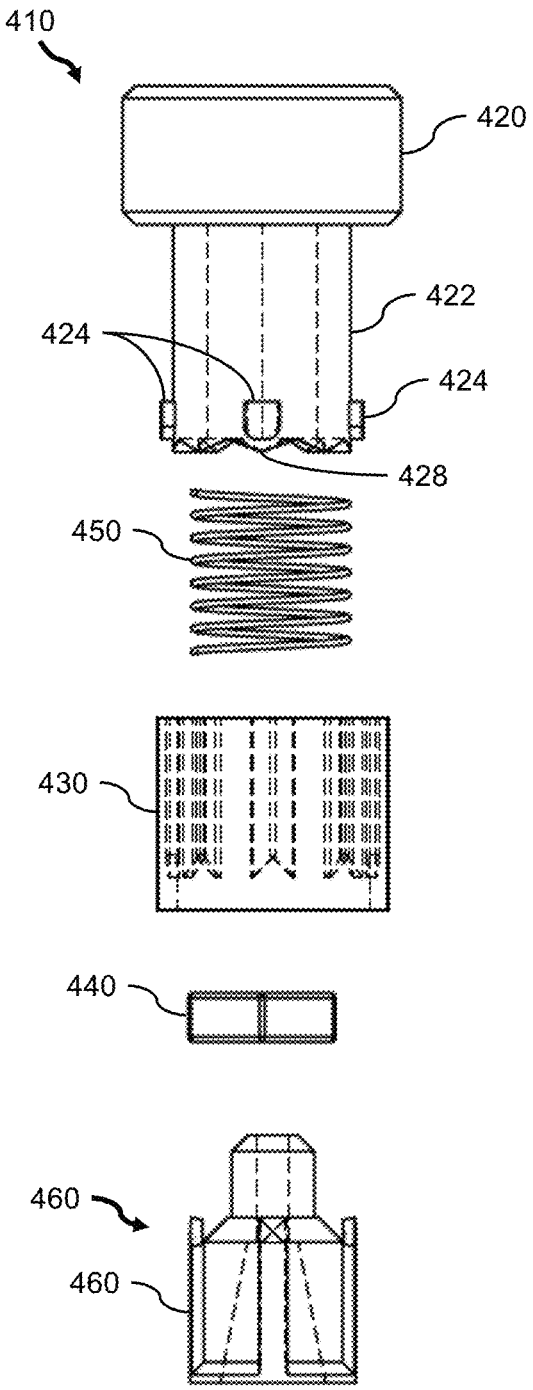
Figure 14A:
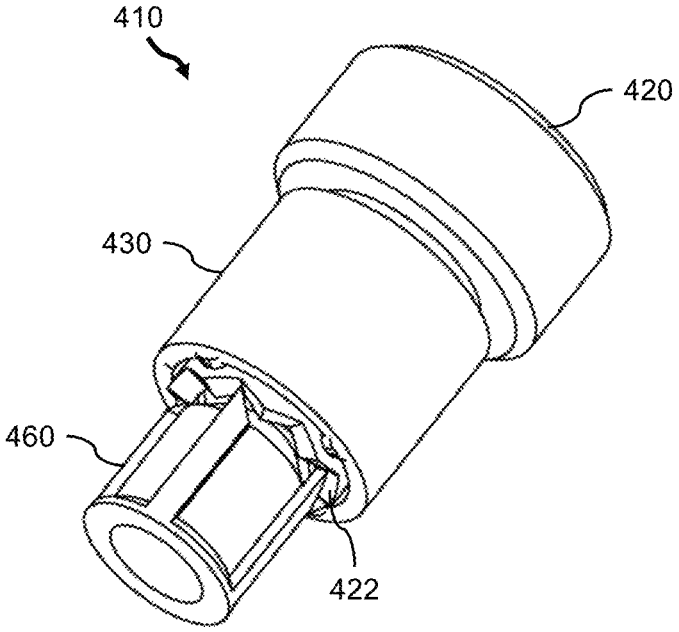
Figure 14B:
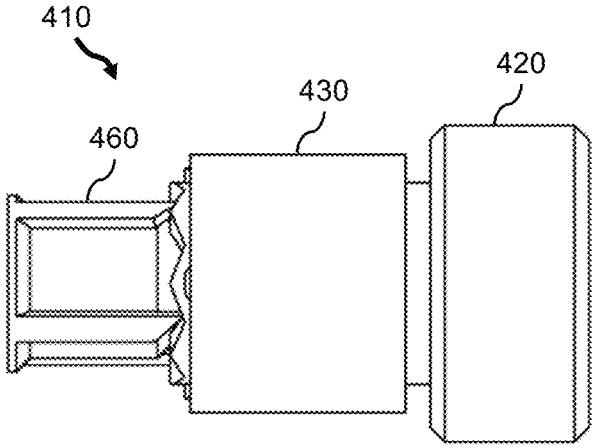
Figure 14C:
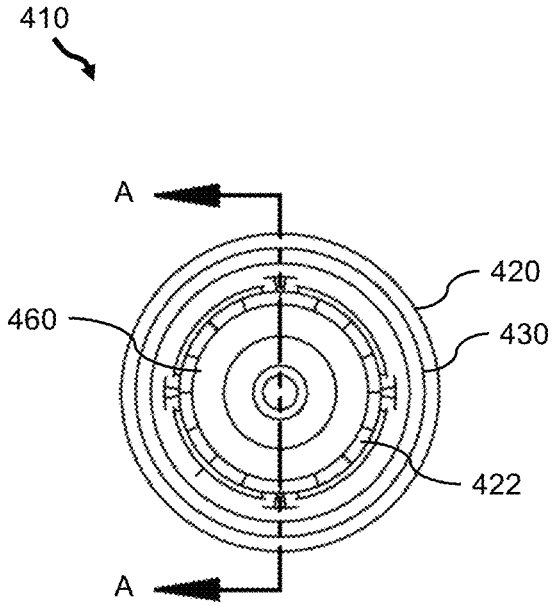
Figure 14D:
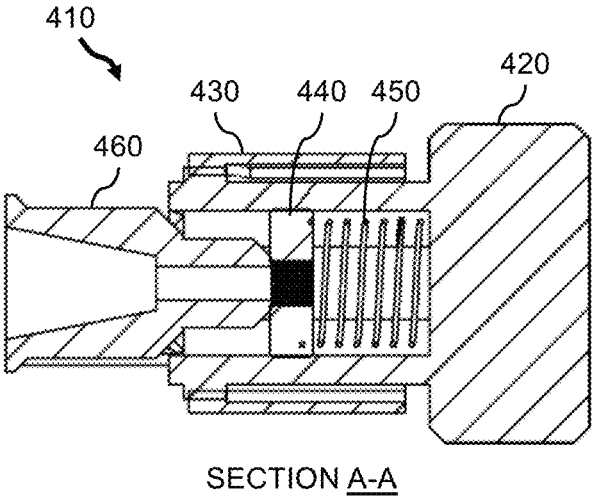
Figure 15A:
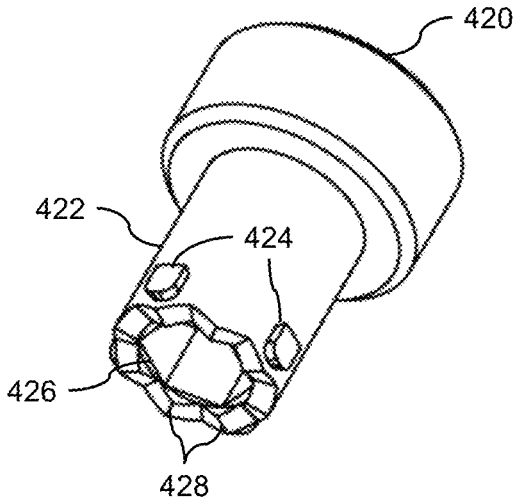
Figure 15B:
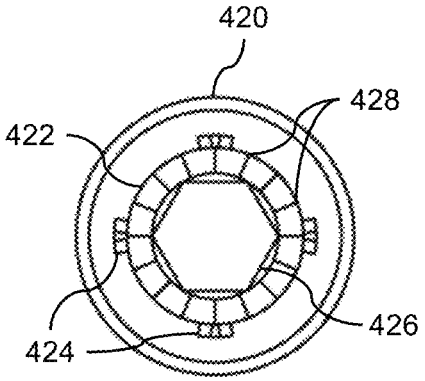
Figure 15C:
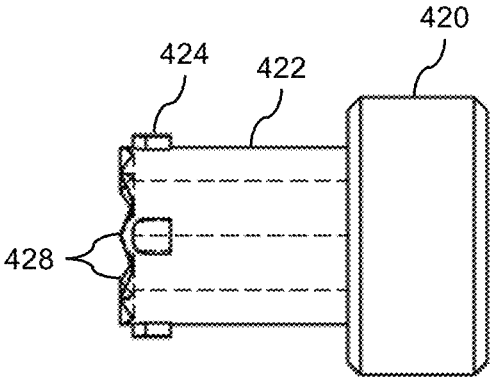
Figure 16A:
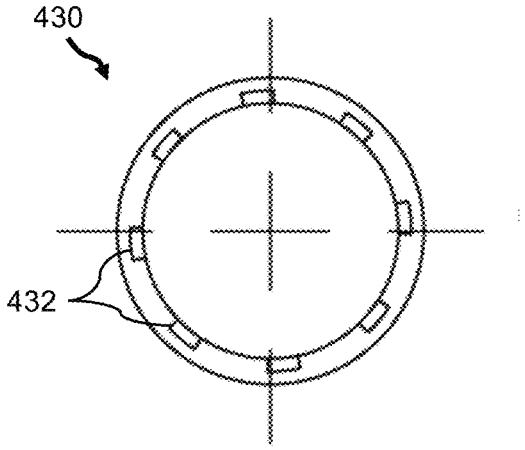
Figure 16B:
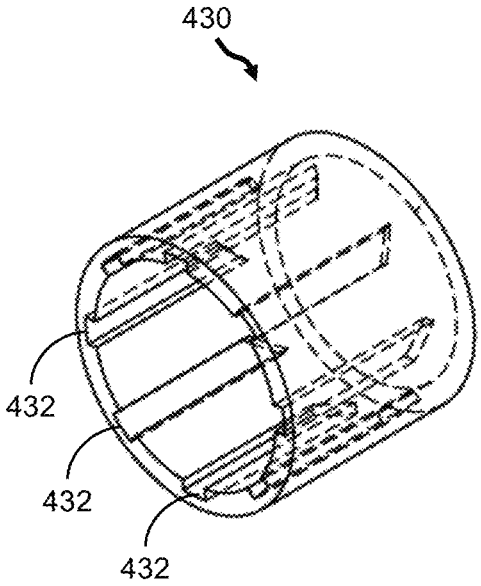
Figure 16C:
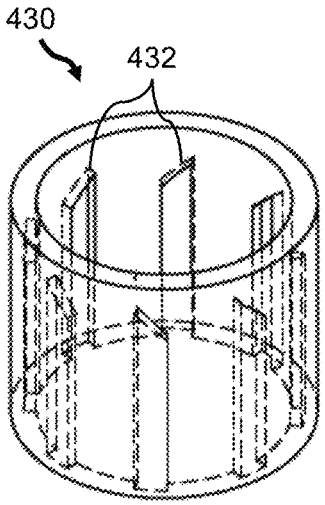
Figure 17A:
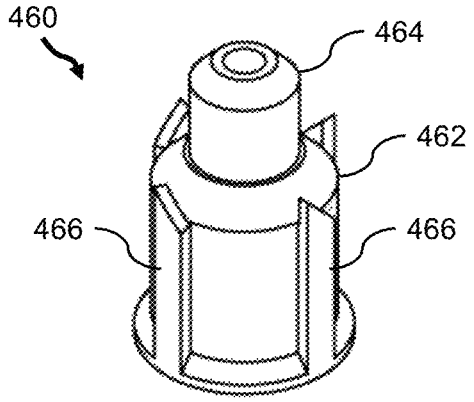
Figure 17B:
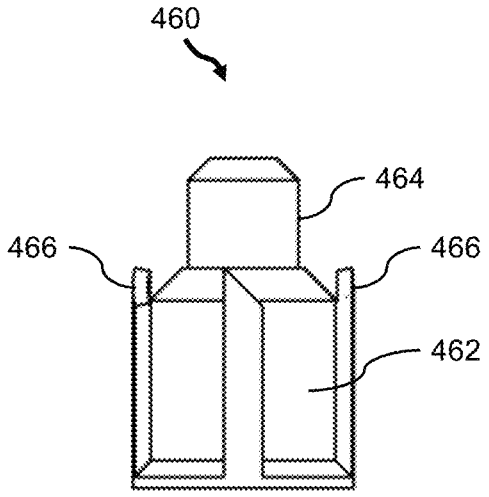
Figure 17C:
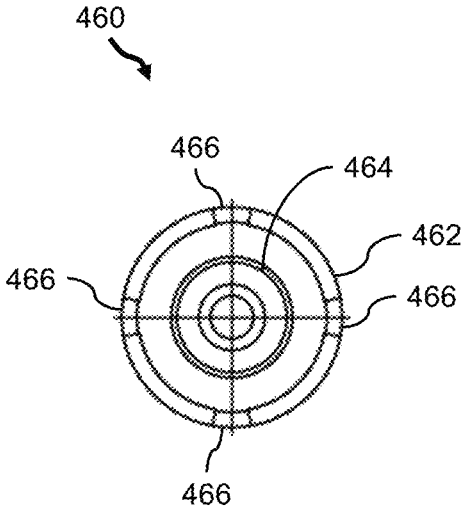
Figure 18:
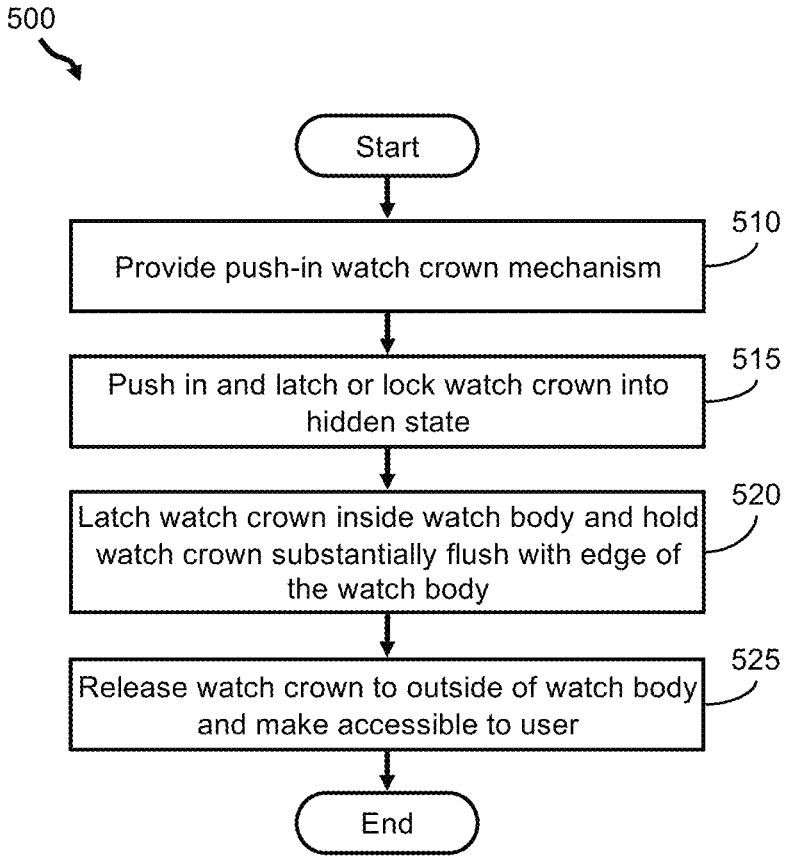
Figure 19:
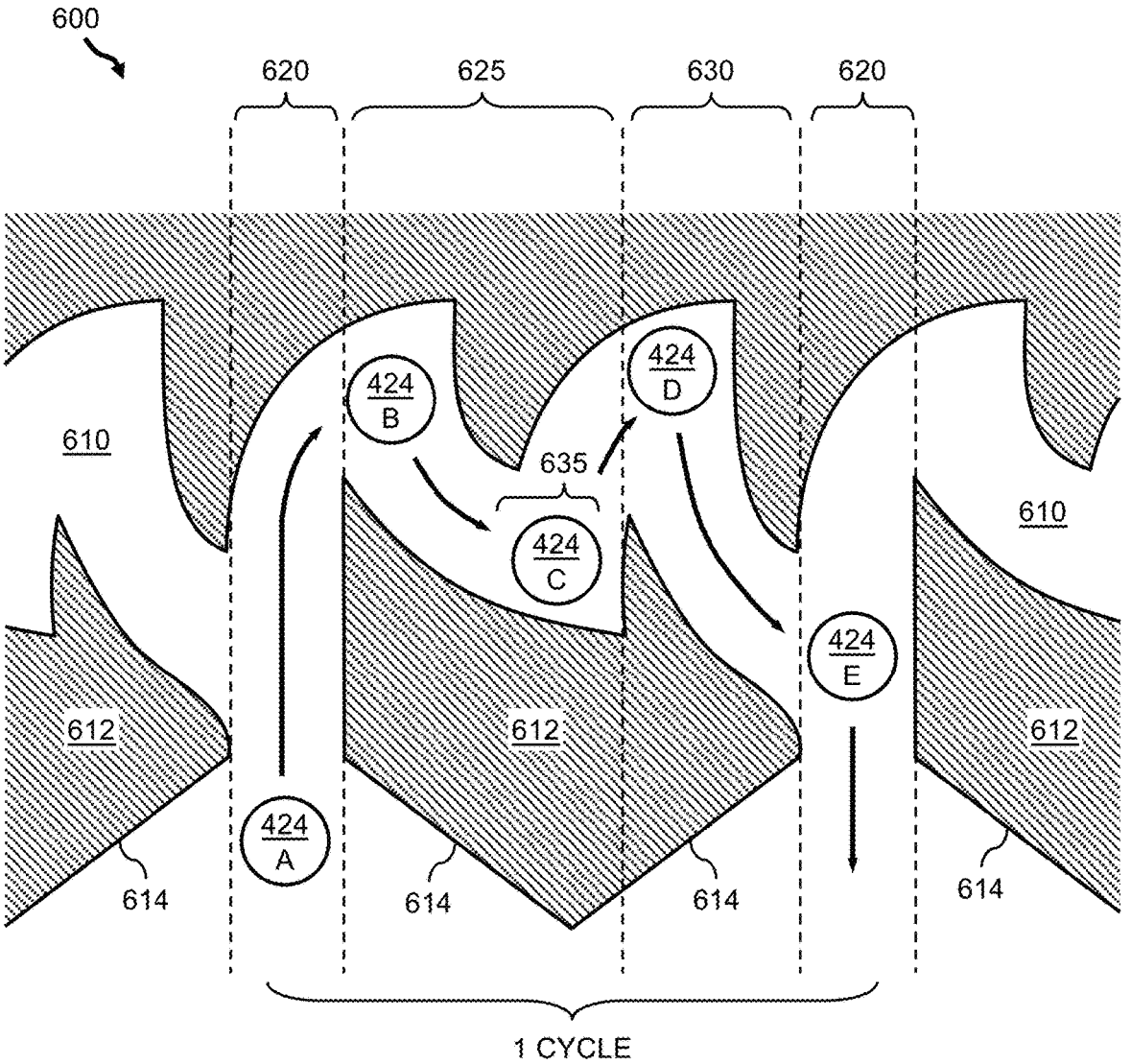

Having thus described the presently disclosed subject matter in general terms, reference will now be made to the accompanying Drawings, which are not necessarily drawn to scale, and wherein:

FIG. 1A illustrates a perspective view and a plan view of an example of the presently disclosed push-in watch crown mechanism when in the released state;

FIG. 1B illustrates a perspective view and a plan view of an example of the presently disclosed push-in watch crown mechanism when in the hidden state;

FIG. 2 illustrates a cross-sectional view of an example of the presently disclosed push-in watch crown mechanism in relation to a watch movement and when in the hidden state;

FIG. 3 illustrates a cross-sectional view of the push-in watch crown mechanism shown in FIG. 2 in relation to a watch movement and when in the released state;

FIG. 4 illustrates a cross-sectional view of the push-in watch crown mechanism shown in FIG. 2 in relation to a watch movement and when in the released and adjustable state;

FIG. 5A, FIG. 5B, and FIG. 5C illustrate an isometric view, a front view, and a cross-sectional view, respectively, of an example of a watch crown assembly of the push-in watch crown mechanism shown in FIG. 2, FIG. 3, and FIG. 4;

FIG. 6A, FIG. 6B, and FIG. 6C illustrate an isometric view, a back view, and a side view, respectively, of an example of a watch crown of the watch crown assembly shown in FIG. 5A, FIG. 5B, and FIG. 5C;

FIG. 7A, FIG. 7B, and FIG. 7C illustrate an isometric view, a front view, and a side view, respectively, of an example of a sleeve of the watch crown assembly shown in FIG. 5A, FIG. 5B, and FIG. 5C;

FIG. 8A, FIG. 8B, and FIG. 8C illustrate an isometric view, a front view, and a side view, respectively, of an example of a collar of the watch crown assembly shown in FIG. 5A, FIG. 5B, and FIG. 5C;

FIG. 9 illustrates a flow diagram of an example of a method of using the presently disclosed push-in watch crown mechanism shown in FIG. 2, FIG. 3, and FIG. 4;

FIG. 10 illustrates a cross-sectional view of another example of the presently disclosed push-in watch crown mechanism in relation to a watch movement and when in the hidden state;

FIG. 11 illustrates a cross-sectional view of the push-in watch crown mechanism shown in FIG. 10 in relation to a watch movement and when in the released state;

FIG. 12 illustrates a cross-sectional view of the push-in watch crown mechanism shown in FIG. 10 in relation to a watch movement and when in the released and adjustable state;

FIG. 13 illustrates an exploded view of a watch crown assembly of the push-in watch crown mechanism shown in FIG. 11, FIG. 12, and FIG. 13;

FIG. 14A, FIG. 14B, FIG. 14C, and FIG. 14D illustrate an isometric view, a side view, a back view, and a cross-sectional view, respectively, of an example of a watch crown assembly of the push-in watch crown mechanism shown in FIG. 11, FIG. 12, and FIG. 13;

FIG. 15A, FIG. 15B, and FIG. 15C illustrate an isometric view, a back view, and a side view, respectively, of an example of a watch crown of the watch crown assembly shown in FIG. 14A, FIG. 14B, FIG. 14C, and FIG. 14D;

FIG. 16A, FIG. 16B, and FIG. 16C illustrate an isometric view, a back view, and a side view, respectively, of an example of a housing of the watch crown assembly shown in FIG. 14A, FIG. 14B, FIG. 14C, and FIG. 14D;

FIG. 17A, FIG. 17B, and FIG. 17C illustrate an isometric view, a back view, and a side view, respectively, of an example of a release mechanism of the watch crown assembly shown in FIG. 14A, FIG. 14B, FIG. 14C, and FIG. 14D;

FIG. 18 illustrates a flow diagram of an example of a method of using the presently disclosed push-in watch crown mechanism shown in FIG. 10, FIG. 11, and FIG. 12; and FIG. 19 illustrates a plan view of an inner portion of another example of a housing of the watch crown assembly shown in FIG. 14A, FIG. 14B, FIG. 14C, and FIG. 14D.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides push-in watch crown mechanisms and methods. The presently disclosed push-in watch crown mechanisms and methods provide a means by which the watch crown can sit substantially flush to the edge of the watch body (or casing) and thereby reduce or entirely eliminate the possibility of the watch crown digging into the user's hand or wrist. Accordingly, the presently disclosed push-in watch crown mechanism ensures that any watch that includes the push-in watch crown mechanism can be worn comfortably.

Namely, the presently disclosed push-in watch crown mechanisms include a locking mechanism for latching the watch crown inside the watch body such that the top of the watch crown is substantially flush to the edge of the watch body. In this way, the watch crown is substantially hidden from view and substantially smooth to the touch with respect to the edge of the watch body. Further, the push-in watch crown mechanisms include a release mechanism for unlatching the watch crown so that it is released outside of the watch body and accessible for use.

In one embodiment, the presently disclosed push-in watch crown mechanisms include a spring-loaded watch crown assembly along with a separate latching member. In this example, the watch crown is pushed into the watch body and held therein via the tip of the latching member. Then, by pushing a pushbutton of the latching member, the watch crown is released.

In another embodiment, the presently disclosed push-in watch crown mechanisms include an integrated toggling release mechanism wherein pushing on the watch crown a first time locks the watch crown inside the watch body and then pushing on the watch crown a second time releases the watch crown, which is spring-loaded. Similar in fashion to how the spring-loaded toggle button of a ballpoint pen works.

Further, the presently disclosed push-in watch crown mechanisms are not limited to wrist watches only. The presently disclosed push-in watch crown mechanisms can be used in any other type of watch, such as a pocket watch. Further, the push-in watch crown mechanisms can be used in mechanical (or analog) watches, quartz watches, and/or any kind of digital watches.

Referring now to FIG. 1A is a perspective view and a plan view of an example of the presently disclosed push-in watch crown mechanism 100 when in the released state. Further, FIG. 1B shows a perspective view and a plan view of the push-in watch crown mechanism 100 when pushed in or in the hidden state. In this example, the push-in watch crown mechanism 100 is installed in a wrist watch 110, wherein the wrist watch 110 can be, for example, a standard mechanical watch, a quartz watch, and the like.

FIG. 1A shows the watch crown of the push-in watch crown mechanism 100 in the released state. Namely, the watch crown is protruding through and outside of the edge of the watch body (i.e., a watch body edge 112). In this state, the user can grasp the watch crown and use the watch crown to perform any functions of the wrist watch 110.

By contrast, FIG. 1B shows the watch crown of the push-in watch crown mechanism 100 when pushed in or in the hidden state. Namely, the watch crown is pushed in and held substantially flush with the watch body edge 112. In this state, the watch crown is substantially hidden from view and substantially smooth to the touch with respect to the watch body edge 112.

The presently disclosed push-in watch crown mechanism 100 can be any mechanism that includes (1) a means by which the watch crown can be pushed inside the watch body and held substantially flush with the edge of the watch body and (2) a means by which the watch crown can be released from inside the watch body such that it is protruding outside of the watch body and accessible by the user. More details of a first example of the presently disclosed push-in watch crown mechanism 100 are shown and described with reference to FIG. 2 through FIG. 9. Further, more details of a second example of the presently disclosed push-in watch crown mechanism 100 are shown and described with reference to FIG. 10 through FIG. 18.

Referring now to FIG. 2 is a cross-sectional view of an example of the presently disclosed push-in watch crown mechanism 200 in relation to a watch movement 114 and when in the hidden state. The push-in watch crown mechanism 200 is one example of the push-in watch crown mechanism 100 described hereinabove with reference to FIG. 1A and FIG. 1B.

Namely, the push-in watch crown mechanism 200 is provided in relation to the watch body edge 112, a watch movement 114, and a watch stem 116 of the wrist watch 110. In this example, the push-in watch crown mechanism 200 includes a watch crown assembly 210 in combination with a crown latching member 260.

The watch crown assembly 210 includes a watch crown 220, a sleeve 230, a collar 240, and a spring 250. The crown latching member 260 includes a rocker arm 262 that is installed on a pin on which the rocker arm 262 can pivot. A release button 264 is provided on the end of the rocker arm 262 that is oriented at the watch body edge 112. A latch tip 266 is provided on the end of the rocker arm 262 that is oriented toward the sleeve 230 of the watch crown assembly 210.

In the watch crown assembly 210, one end of the sleeve 230 is fitted to the inside of the watch crown 220. The opposite end of the sleeve 230 has a tapered rim or lip 234 for engaging with the crown latching member 260. The collar 240 is fitted inside the sleeve 230 and the spring 250 is fitted between the collar 240 and the watch crown 220. Accordingly, the watch crown assembly 210 is a spring-loaded mechanism.

In the watch crown assembly 210, the collar 240 is held fixed on the watch stem 116 of the wrist watch 110. The collar 240 is set a certain distance from the watch body edge 112 such that there is sufficient clearance to allow the watch crown 220 to be either hidden inside the watch body edge 112 or released to the outside of the watch body edge 112. The sleeve 230 is coupled to the inside of the watch crown 220. Further, the sleeve 230 is slideably coupled to the collar 240. Accordingly, the sleeve 230 and the watch crown 220 are movable with respect to the collar 240.

Referring still to FIG. 2, the watch crown 220 is pushed inside the watch body edge 112 such that the rim or lip 234 of the sleeve 230 engages with the latch tip 266 of the crown latching member 260. In this way, the watch crown 220 is held such the top of the watch crown 220 is substantially flush to the watch body edge 112 and wherein the watch crown 220 is substantially hidden from view and substantially smooth to the touch with respect to the watch body edge 112.

Referring now to FIG. 3 is a cross-sectional view of the push-in watch crown mechanism 200 shown in FIG. 2 in relation to the watch body edge 112 and the watch movement 114 and when in the released state. Namely, when the release button 264 of the crown latching member 260 is pushed, the latch tip 266 of the crown latching member 260 disengages from the rim or lip 234 of the sleeve 230. Then, the force of the spring 250 pushes the watch crown 220 outside of the watch body edge 112 and the watch crown 220 is now accessible by the user. In this state, the user can grasp the watch crown 220 and use the watch crown 220 to perform any functions of the wrist watch 110. Namely, FIG. 4 shows that the watch crown 220 can be pulled out yet further to perform any functions of the wrist watch 110, such as, but not limited to, setting the time of the watch. More details of the watch crown 220, the sleeve 230, the collar 240, and the spring 250 are shown and described hereinbelow with respect to FIG. 5A through 8C.

Referring now to FIG. 5A, FIG. 5B, and FIG. 5C is an isometric view, a front view, and a cross-sectional view, respectively, of an example of the watch crown assembly 210 of the push-in watch crown mechanism 200 shown in FIG. 2, FIG. 3, and FIG. 4. Namely, FIG. 5C a cross-sectional view of the watch crown assembly 210 taken along line A-A of FIG. 5B. Again, the watch crown assembly 210 includes the watch crown 220, the sleeve 230, the collar 240, and the spring 250.

Referring now to FIG. 6A, FIG. 6B, and FIG. 6C is an isometric view, a back view, and a side view, respectively, of an example of the watch crown 220 of the watch crown assembly 210 shown in FIG. 5A, FIG. 5B, and FIG. 5C. The watch crown 220 has a standard cylindrical watch crown shape. An arrangement of ridges 222 are provided around the perimeter of the watch crown 220 to enable easy gripping thereof. Further, a substantially circular recessed receptacle 224 is provided on the inside surface of the watch crown 220. The receptacle 224 is designed to receive the end of the sleeve 230. The sleeve 230 can be, for example, press-fitted and adhered into the receptacle 224 of the watch crown 220. In one example, the watch crown 220 has a diameter of about 7.7 mm and a height of about 4 mm. However, these dimensions are exemplary only. The dimensions can vary.

Referring now to FIG. 7A, FIG. 7B, and FIG. 7C is an isometric view, a front view, and a side view, respectively, of an example of the sleeve 230 of the watch crown assembly 210 shown in FIG. 5A, FIG. 5B, and FIG. 5C. A main body 232 of the sleeve 230 is a hollow cylinder-shaped member that has an inside channel 236. Again, the rim or lip 234 is provided on one end of the body 232, whereas the opposite end of the body 232 is fitted into the receptacle 224 of the watch crown 220. In this example, the inside channel 236 of the sleeve 230 is a hexagon shape to match the profile of the hexagon-shaped collar 240, so that when the sleeve 230 is turned, it locks the watch stem 116 to the collar 240. In one example, the sleeve 230 has an overall length of about 6.5 mm. In one example, the body 232 of the sleeve 230 has an inside diameter of about 3 mm (i.e., hex diameter) and an outside diameter of about 4 mm. In one example, the rim or lip 234 of the sleeve 230 has a major diameter of about 5.07 mm and a minor diameter of about 4.14 mm. However, these dimensions are exemplary only. The dimensions can vary.

Referring now to FIG. 8A, FIG. 8B, and FIG. 8C is an isometric view, a front view, and a side view, respectively, of an example of the collar 240 of the watch crown assembly 210 shown in FIG. 5A, FIG. 5B, and FIG. 5C. In this example, the collar 240 is hexagon-shaped and has a through-hole 242 for fitting to the watch stem 116 of the wrist watch 110. In one example, the collar 240 and has a width of about 3 mm and a thickness of about 1 mm. However, these dimensions are exemplary only. The dimensions can vary.

In the watch crown assembly 210, the collar 240 and the inside of the sleeve 230 is not limited to hexagonal. The collar 240 and the inside of the inside of the sleeve 230 can be any shape, such as, but not limited to, triangular, pentagonal, square, torx- or star-shaped, splined, and the like, or any shape that allows the two components to interlock and rotate together about the axis of the watch stem 116.

Referring again to FIG. 2 through FIG. 8C, the components of the push-in watch crown mechanism 200 can be formed of any durable, rigid, waterproof or water-resistant materials, such as, but not limited to, molded plastic, stainless steel, aluminum, an alloy, and any combinations thereof.

Referring now to FIG. 9 is a flow diagram of an example of a method 300 of using the presently disclosed push-in watch crown mechanism 200 shown in FIG. 2, FIG. 3, and FIG. 4. The method 300 may include, but is not limited to, the following steps.

At a step 310, the presently disclosed push-in watch crown mechanism is provided in a watch. For example, the push-in watch crown mechanism 200 is provided in the wrist watch 110 as shown, for example, in FIG. 2, FIG. 3, and FIG. 4.

At a step 315, the watch crown is pushed in and latched or locked into the hidden state. For example, the user overcomes the spring force of the spring 250 and pushes the watch crown 220 of the watch crown assembly 210 into the wrist watch 110.

At a step 320, the watch crown is latched inside the watch body and then held substantially flush with the edge of the watch body. For example, the rim or lip 234 of the sleeve 230 engages with the latch tip 266 of the crown latching member 260. In this way, the watch crown 220 is latched inside the body of the wrist watch 110 and held substantially flush with the watch body edge 112 as shown, for example, in FIG. 2.

At a step 325, the watch crown is released to the outside of the watch body and made accessible to the user. For example, the user presses on the release button 264 of the crown latching member 260, which causes the latch tip 266 of the crown latching member 260 to release the rim or lip 234 of the sleeve 230. In this way, the watch crown 220 is released from inside the body of the wrist watch 110 and made accessible outside the watch body edge 112 as shown, for example, in FIG. 3 and FIG. 4.

Referring now to FIG. 10 is a cross-sectional view of another example of the presently disclosed push-in watch crown mechanism 400 in relation to the watch movement 114 and when in the hidden state. The push-in watch crown mechanism 400 is another example of the push-in watch crown mechanism 100 described hereinabove with reference to FIG. 1A and FIG. 1B.

Namely, the push-in watch crown mechanism 400 is provided in relation to the watch body edge 112, the watch movement 114, and the watch stem 116 of the wrist watch 110. In this example, the push-in watch crown mechanism 400 includes a watch crown assembly 410.

The watch crown assembly 410 includes a watch crown 420, a housing 430, a collar 440, a spring 450, and a release mechanism 460. The watch crown 420 also includes a hollow sleeve portion 422 that is integrated in one piece with the watch crown portion (see FIG. 15A, FIG. 15B, FIG. 15C). Further, a plurality of guide knobs 424 are provided on the sleeve portion 422 of the watch crown 420. Further, an arrangement of teeth 428 are provided on the tip of the sleeve portion 422 of the watch crown 420. The housing 430 is a hollow tubular member that includes an arrangement of internal slots 432 for receiving certain guide features 466 of the release mechanism 460 (see FIG. 17A, FIG. 17B, FIG. 17C). Further, the release mechanism 460 includes a wide portion 462 and a narrow portion 464, wherein the narrow portion 464 is oriented toward the sleeve portion 422 of the watch crown 420. The guide knobs 424 of the watch crown 420 engage with the release mechanism 460 at the transition area between the wide portion 462 and the narrow portion 464.

In the watch crown assembly 410, the collar 440 is fitted inside the sleeve portion 422 of the watch crown 420 and the spring 450 is fitted between the collar 440 and the watch crown 420. Accordingly, the watch crown assembly 410 is a spring-loaded mechanism.

In the watch crown assembly 410, the collar 440 is held fixed on the watch stem 116 of the wrist watch 110. The collar 440 is set a certain distance from the watch body edge 112 such that there is sufficient clearance to allow the watch crown 420 to be either hidden inside the watch body edge 112 or released to the outside of the watch body edge 112. Further, the inside of the sleeve portion 422 of the watch crown 420 is slideably coupled to the collar 440. Accordingly, the sleeve portion 422 of the watch crown 420 is movable with respect to the collar 440. Further, the sleeve portion 422 of the watch crown 420 is slideably coupled to the inside of the housing 430. Namely, the guide knobs 424 on the sleeve portion 422 of the watch crown 420 engage with the internal slots 432 of the housing 430. Further, the narrow portion 464 of the release mechanism 460 is butted against the sleeve portion 422 of the watch crown 420 and the wide portion 462 of the release mechanism 460 is slideably coupled to the inside of the housing 430. Further, the ends of the guide features 466 of the release mechanism 460 engage with the teeth 428 on the tip of the sleeve portion 422 of the watch crown 420. Additionally, the housing 430 is held in a fixed position with respect to the body of the wrist watch 110 and the watch body edge 112.

The watch crown assembly 410 works in similar fashion to how the spring-loaded toggle button of a ballpoint pen works. For example, the watch crown assembly 410 provides an integrated toggling release mechanism wherein pushing on the watch crown 420 a first time locks the watch crown 420 inside the watch body, as shown in FIG. 10, and then pushing on the watch crown 420 a second time releases the watch crown 420, as shown in FIG. 11 and FIG. 12. Namely, FIG. 11 shows the watch crown assembly 410 in relation to the watch body edge 112 and the watch movement 114 and when in the released state, while FIG. 12 shows the watch crown assembly 410 in relation to the watch body edge 112 and the watch crown assembly 410 and when in the released and adjustable state.

More specifically, the release mechanism 460 allows the watch crown 420 to be released out of the watch case through the guidance of the internal slots 432 of the housing 430. The release mechanism 460 comes in contact with the collar 440. The spring 450 is located inside the watch crown 420 and in direct contact with the collar 440. The watch crown 420 is used to pull the collar 440, wherein the collar 440 is fixed to the watch stem 116 that engages the watch movement 114 to set the time. By pushing the watch crown 420 into the watch case, the internal slots 432 of the housing 430 locks the watch crown 420 into the case. Through the use of an addition manual push by the user, the watch crown 420 is released through the use of the housing 430 and the release mechanism 460. This push release mechanism, similar in relation to a mechanical click pen, allows the user to push the crown into the housing to lock the crown into place, then by pushing the crown a second time releases the crown out of the watch case.

More details of the operation of the watch crown assembly 410 is as follows. The watch crown 420 has external guide knobs 424 that align to the internal slots 432 of the housing 430. The housing 430 remains in a fixed position relative to the watch case. The internal slots 432 of the housing 430 allow the watch crown 420 to be guided inside the watch case. The internal slots 432 of the housing 430 function in two ways. For example, half of the internal slots 432 (e.g., 4 of 8 slots, alternating slots) allows the watch crown 420 to be pushed in and then locked inside. The other half of the internal slots 432 (e.g., the remaining 4 of 8 slots, alternating slots) allows the watch crown 420 to be released outside the watch case. Accordingly, one half of the internal slots 432 (i.e., alternating slots) can be called "locking" internal slots 432 and the other half of the internal slots 432 (i.e., alternating slots) can be called "releasing" internal slots 432.

The total number of internal slots 432 in the housing 430 is not critical to overall function. For example, if the watch crown 420 has four guide knobs 424, then there would be eight internal slots 432 in the housing 430 (4 for releasing, 4 for locking); if the watch crown 420 has five guide knobs 424, then there would be ten internal slots 432 in the housing 430 (5 for releasing, 5 for locking); and so on. The internal slots 432 (locking and releasing) are alternating in order inside the housing 430.

The release mechanism 460 allows the watch crown 420 to be released out of the watch case via the external guide features 466. The release mechanism 460 is free to rotate axially, relative to the entire watch crown mechanism 400 and to the watch stem 116. The guide features 466 of the release mechanism 460 are angled to match the profile of the teeth 428 of the watch crown 420 and thereby interlock the watch crown 420 and the release mechanism 460. In so doing, turning the watch crown 420 to lock into the "locking" internal slots 432 of the housing 430 or to turn the watch crown 420 to release into the "releasing" internal slots 432 of the housing 430. Namely, the release mechanism 460 allows the watch crown 420 to move from the "locking" internal slots 432 to the "releasing" internal slots 432 of the housing 430, or vice versa.

At one end of the housing 430 there is a small portion that has no internal slots 432. That is, the internal slots 432 do not extend the full length of the housing 430. This provides a clearance region on which the guide knobs 424 of the watch crown 420 can ride. Namely, in this clearance region the guide knobs 424 of the watch crown 420 are free to rotate axially about the watch stem 116 in this portion of the housing 430. This is so that when the watch crown 420 is pulled out, for example, to engage the watch stem 116 to change the time or feature, the guide knobs 424 are free to spin in this portion of the housing 430 in order to adjust the watch features or time.

Referring now to FIG. 13 is an exploded view of the watch crown assembly 410 of the push-in watch crown mechanism 400 shown in FIG. 11, FIG. 12, and FIG. 13. Again, the watch crown assembly 410 includes the watch crown 420, the housing 430, the collar 440, the spring 450, and the release mechanism 460. Further, FIG. 14A, FIG. 14B, FIG. 14C, and FIG. 14D show an isometric view, a side view, a back view, and a cross-sectional view, respectively, of the watch crown assembly 410. Namely, FIG. 14D is a cross-sectional view taken along line A-A of FIG. 14C.

Referring now to FIG. 15A, FIG. 15B, and FIG. 15C is an isometric view, a back view, and a side view, respectively, of an example of the watch crown 420 of the watch crown assembly 410 shown in FIG. 14A, FIG. 14B, FIG. 14C, and FIG. 14D. Again, the watch crown 420 is integrated with the sleeve portion 422 and the guide knobs 424 are provided on the sleeve portion 422. Further, the sleeve portion 422 of the watch crown 420 has an inside channel 426. In this example, the inside channel 426 of the sleeve portion 422 is a hexagon shape to match the profile of the hexagon-shaped the collar 440. The collar 440 of the watch crown assembly 410 is substantially the same at the collar 240 of the watch crown assembly 210. Again, the shape of the collar 440 and the inside channel 426 is not limited to hexagonal. Any shape is possible.

In one example, the watch crown 420 has a diameter of about 7 mm and a height of about 4 mm. The sleeve portion 422 of the watch crown 420 has a length of about 5.5 mm, an inside diameter of about 3 mm (i.e., hex diameter), and an outside diameter of about 4.5 mm. In one example, the collar 440 and has a width of about 3 mm and a thickness of about 1 mm. However, these dimensions are exemplary only. The dimensions can vary.

Referring now to FIG. 16A, FIG. 16B, and FIG. 16C is an isometric view, a back view, and a side view, respectively, of an example of the housing 430 of the watch crown assembly 410 shown in FIG. 14A, FIG. 14B, FIG. 14C, and FIG. 14D. Again, the housing 430 is a hollow tubular member that includes an arrangement of slots 432 for receiving the guide features 466 of the release mechanism 460. In one example, the housing 430 has a length of about 4.5 mm, an inside diameter of about 4.5 mm, and an outside diameter of about 5.5 mm. However, these dimensions are exemplary only. The dimensions can vary.

Referring now to FIG. 17A, FIG. 17B, and FIG. 17C illustrate an isometric view, a back view, and a side view, respectively, of an example of the release mechanism 460 of the watch crown assembly 410 shown in FIG. 14A, FIG. 14B, FIG. 14C, and FIG. 14D. Again, the release mechanism 460 includes the wide portion 462 and the narrow portion 464. A set of guide features 466 is provided on the wide portion 462 of the release mechanism 460. The guide features 466 are designed to be slideably fitted into the slots 432 of the housing 430. In one example, the release mechanism 460 has an overall length of about 6 mm and an overall diameter of about 4 mm. However, these dimensions are exemplary only. The dimensions can vary.

Referring again to FIG. 10 through FIG. 17C, the components of the push-in watch crown mechanism 400 can be formed of any durable, rigid, waterproof or water-resistant materials, such as, but not limited to, molded plastic, stainless steel, aluminum, an alloy, and any combinations thereof.

Referring now to FIG. 18 is a flow diagram of an example of a method 500 of using the presently disclosed push-in watch crown mechanism 400 shown in FIG. 10, FIG. 11, and FIG. 12; namely, using the watch crown assembly 410. The method 500 may include, but is not limited to, the following steps.

At a step 510, the presently disclosed push-in watch crown mechanism 400 is provided in a watch. For example, the watch crown assembly 410 of the push-in watch crown mechanism 400 is provided in the wrist watch 110 as shown, for example, in FIG. 10, FIG. 11, and FIG. 12.

At a step 515, the watch crown is pushed in and latched or locked into the hidden state. For example, the user overcomes the spring force of the spring 450 and pushes the watch crown 420 of the watch crown assembly 410 into the wrist watch 110.

At a step 520, the watch crown is latched inside the watch body and then held substantially flush with the edge of the watch body. Namely, the release mechanism 460 allows the guide knobs 424 of the watch crown 420 to move to the "locking" internal slots 432 of the housing 430. In this way, the watch crown 420 is latched inside the body of the wrist watch 110 and held substantially flush with the watch body edge 112 as shown, for example, in FIG. 10.

At a step 525, the watch crown is released to the outside of the watch body and made accessible to the user. For example, the user presses the watch crown 420 of the watch crown assembly 410, which causes the guide knobs 424 of the watch crown 420 to move from the "locking" internal slots 432 to the "releasing" internal slots 432 of the housing 430. In this way, the watch crown 420 is released from inside the body of the wrist watch 110 and made accessible outside the watch body edge 112 as shown, for example, in FIG. 11 and FIG. 12.

In another embodiment, the watch crown assembly 410 shown in FIG. 14A, FIG. 14B, FIG. 14C, and FIG. 14D is absent the release mechanism 460 and a different design feature is added to the housing. Namely, the housing includes features of both the housing 430 and the release mechanism 460 and operates substantially the same as the combination of the separate housing 430 and release mechanism 460. For example, FIG. 19 shows a plan view of an inner portion of another example of a housing of the watch crown assembly 410 shown in FIG. 14A, FIG. 14B, FIG. 14C, and FIG. 14D. Namely, a housing 600 is provided that includes features for both locking and releasing the watch crown 420. The housing 600 operates in the absence of the release mechanism 460.

A substantially continuous slot 610 is provided in ring-fashion around the inner surface of the housing 600 of which only a portion is shown in FIG. 19. The slot 610 is designed to receive and guide the guide knobs 424 of the watch crown 420. Generally, the slot 610 has a curved saw tooth type of shape that has certain entry/exit points. For example, certain islands of material (e.g., islands 612) help define entry/exit portions 620 of the slot 610. Namely, in one operating sequence the slot 610 includes an entry/exit portion 620, followed by a locking portion 625, followed by a releasing portion 630, followed by another entry/exit portion 620. Further, the slot 610 includes a locking pocket 635 at the trough between the locking portion 625 and the releasing portion 630. Further, angled surfaces 614 of islands 612 help to guide the guide knobs 424 of the watch crown 420 to/from the entry/exit portions 620 of the slot 610. Further, in, for example, the wrist watch 110, the entry/exit portions 620 of the slot 610 are oriented toward the watch body edge 112.

One full locking and releasing cycle is shown in FIG. 19. In a first portion of the cycle, the guide knob 424 slides into one of the entry/exit portions 620 of the slot 610 (see position 424A). In a next portion of the cycle, the guide knob 424 slides into the locking portion 625 of the slot 610 (see position 424B). In a next portion of the cycle, the guide knob 424 slides into the locking pocket 635 of the slot 610 (see position 424C). Note that when the guide knobs 424 are in the locking pockets 635, the watch crown 420 will be in the hidden or pushed-in state. In a next portion of the cycle, the guide knob 424 slides into the releasing portion 630 of the slot 610 (see position 424D). In a next portion of the cycle, the guide knob 424 slides out of the next entry/exit portion 620 of the slot 610 (see position 424E), thereby completing the cycle. Each time a user pushes the watch crown 420, the guide knobs 424 of the watch crown 420 "walk" around the slot 610 and the watch crown 420 alternates between locked and released. The spring 450 provides the energy/force for "walking" the guide knobs 424 of the watch crown 420 around the slot 610. Further, the curves in the slot 610 help facilitate the movement of the guide knobs 424 along the slot 610.

Similar to the housing 430 shown in FIG. 16A, FIG. 16B, and FIG. 16C, at one end of the housing 600 there is a small portion that is free of the slot 610. This provides a clearance region on which the guide knobs 424 of the watch crown 420 can ride. Namely, in this clearance region the guide knobs 424 of the watch crown 420 are free to rotate axially about the watch stem 116 in this portion of the housing 600. This is so that when the watch crown 420 is pulled out, for example, to engage the watch stem 116 to change the time or feature, the guide knobs 424 are free to spin in this portion of the housing 600 in order to adjust the watch features or time.

Referring now again to FIG. 1A through FIG. 19, in the presently disclosed push-in watch crown mechanisms 100, 200, and 400 a wide variety of manufacturing processes or materials that can be used. One applicable manufacturing process to make the components thereof is by machining, manual milling or lathes, or computer numerical control (CNC) machines. Another applicable manufacturing process is part casting or injection molding using different alloys or plastics. Different materials can be used for each component. For example, stainless steel or an alloy can be used, although plastic may be an option for most components.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A push-in watch crown mechanism in a watch, wherein the watch comprises a watch body comprising a watch body edge, and wherein the push-in watch mechanism comprises:

a watch crown;

a means by which the watch crown can be pushed inside the watch body and held substantially flush with the watch body edge; and a means by which the watch crown can be released from inside the watch body such that the watch crown is protruding outside of the watch body and accessible by a user;

wherein when the watch crown is pushed inside the watch body and held substantially flush with the watch body edge, the watch crown is substantially hidden from view and substantially smooth to the touch with respect to the watch body edge;

wherein the watch further comprises a watch movement and a watch stem;

wherein the push-in watch crown mechanism is provided in relation to the watch body edge, the watch movement, and the watch stem;

wherein the push-in watch crown mechanism comprises a watch crown assembly in combination with a crown latching member, wherein the crown latching member comprises a rocker arm installed on a pin on which the rocker arm can pivot; and wherein the watch crown assembly comprises a watch crown, a sleeve, a collar, and a spring.

2. The push-in watch crown mechanism of claim 1, further comprising a release button provided on an end of the rocker arm that is oriented at the watch body edge, and comprising a latch tip provided on an end of the rocker arm that is oriented toward the sleeve of the watch crown assembly.

3. The push-in watch crown mechanism of claim 2, wherein in the watch crown assembly, one end of the sleeve is fitted to the inside of the watch crown, and wherein an opposite end of the sleeve has a tapered rim or lip configured to engage with the crown latching member.

4. The push-in watch crown mechanism of claim 3, wherein the collar is fitted inside the sleeve, and wherein the spring is fitted between the collar and the watch crown.

5. The push-in watch crown mechanism of claim 4, wherein the watch crown assembly is a spring-loaded mechanism.

6. The push-in watch crown mechanism of claim 5, wherein in the watch crown assembly, the collar is held fixed on the watch stem of the watch, and further wherein the collar is set a certain distance from the watch body edge such that there is sufficient clearance to allow the watch crown to be either hidden inside the watch body edge or released to the outside of the watch body edge.

7. The push-in watch crown mechanism of claim 6, wherein the sleeve is coupled to the inside of the watch crown, the sleeve is slideably coupled to the collar, and the sleeve and the watch crown are movable with respect to the collar.

8. The push-in watch crown mechanism of claim 7, wherein the watch crown is configured to be pushed inside the watch body edge such that the rim or lip of the sleeve engages with the latch tip of the crown latching member, thereby holding the watch crown such that the top of the watch crown is substantially flush to the watch body edge and wherein the watch crown is substantially hidden from view and substantially smooth to the touch with respect to the watch body edge.

9. The push-in watch crown mechanism of claim 8, configured such that when the release button of the crown latching member is pushed, the latch tip of the crown latching member disengages from the rim or lip of the sleeve allowing the force of the spring to push the watch crown outside of the watch body edge, thereby allowing the watch crown to be accessible by the user.

10. The push-in watch crown mechanism of claim 9, wherein the watch crown is configured to be pulled out to perform any functions of the watch.

11. A method of using the push-in watch crown mechanism of claim 10, comprising the steps of:

a. providing the push-in watch crown mechanism in the watch;

b. pushing the watch crown of the watch crown mechanism into the watch such that the the rim or lip of the sleeve engages with the latch tip of the crown latching member, thereby latching or locking the watch crown into a hidden state inside the watch body whereby the watch crown is held substantially flush with the the watch body edge;

c. pressing the release button of the crown latching member, thereby causing the latch tip of the crown latching member to release the rim or lip of the sleeve, whereby the watch crown is released from inside the watch body and made accessible outside the watch body edge.

12. A push-in watch crown mechanism in a watch, wherein the watch comprises a watch body comprising a watch body edge, and wherein the push-in watch mechanism comprises:

a watch crown;

a means by which the watch crown can be pushed inside the watch body and held substantially flush with the watch body edge; and a means by which the watch crown can be released from inside the watch body such that the watch crown is protruding outside of the watch body and accessible by a user;

wherein when the watch crown is pushed inside the watch body and held substantially flush with the watch body edge, the watch crown is substantially hidden from view and substantially smooth to the touch with respect to the watch body edge;

wherein the watch further comprises a watch movement and a watch stem;

wherein the push-in watch crown mechanism is provided in relation to the watch body edge, the watch movement, and the watch stem; and wherein the push-in watch crown mechanism comprises a watch crown assembly in combination with a crown latching member; and further wherein the watch crown assembly comprises a watch crown, a housing, a collar, a spring, and a release mechanism.

13. The push-in watch crown mechanism of claim 12, wherein:

the watch crown comprises a hollow sleeve portion that is integrated in one piece with the watch crown portion;

a plurality of guide knobs is provided on the sleeve portion of the watch crown; and an arrangement of teeth is provided on the tip of the sleeve portion of the watch crown; further wherein the housing is a hollow tubular member that comprises an arrangement of internal slots for receiving guide features of the release mechanism; wherein the release mechanism comprises a wide portion and a narrow portion, wherein the narrow portion is oriented toward the sleeve portion of the watch crown; and wherein the guide knobs of the watch crown engage with the release mechanism at a transition area between the wide portion and the narrow portion.

14. The push-in watch crown mechanism of claim 13, wherein the collar is fitted inside the sleeve portion of the watch crown and the spring is fitted between the collar and the watch crown, whereby the watch crown assembly is a spring-loaded mechanism.

15. The push-in watch crown mechanism of claim 14, wherein:

the collar is held fixed on the watch stem of the watch and is set a certain distance from the watch body edge such that there is sufficient clearance to allow the watch crown to be either hidden inside the watch body edge or released to the outside of the watch body edge;

the inside of the sleeve portion of the watch crown is slideably coupled to the collar, whereby the sleeve portion of the watch crown is movable with respect to the collar; and the sleeve portion of the watch crown is slideably coupled to the inside of the housing, whereby the guide knobs on the sleeve portion of the watch crown engage with the internal slots of the housing.

16. The push-in watch crown mechanism of claim 15, wherein:

the narrow portion of the release mechanism is butted against the sleeve portion of the watch crown and the wide portion of the release mechanism is slideably coupled to the inside of the housing;

the ends of the guide features of the release mechanism engage with the teeth on the tip of the sleeve portion of the watch crown; and the housing is held in a fixed position with respect to the body of the watch and the watch body edge.

17. The push-in watch crown mechanism of claim 16, wherein:

the watch crown assembly provides an integrated toggling release mechanism wherein pushing on the watch crown a first time locks the watch crown inside the watch body and pushing on the watch crown a second time releases the watch crown;

the release mechanism allows the watch crown to be released out of the watch case through the guidance of the internal slots of the housing;

the release mechanism comes in contact with the collar;

the spring is located inside the watch crown and in direct contact with the collar; and the watch crown is used to pull the collar, wherein the collar is fixed to the watch stem that engages the watch movement to set the time; and wherein by pushing the watch crown into the watch case, the internal slots of the housing locks the watch crown into the case, and whereby through the use of an additional manual push by the user, the watch crown is released through the use of the housing and the release mechanism.

18. The push-in watch crown mechanism of claim 17, wherein:

the watch crown has external guide knobs that align to the internal slots of the housing;

the housing remains in a fixed position relative to the watch case;

the internal slots of the housing allow the watch crown to be guided inside the watch case, whereby some of the internal slots allow the watch crown to be pushed in and then locked inside, thereby producing locking internal slots, and whereby other internal slots allow the watch crown to be released outside the watch case, thereby producing releasing internal slots.

19. The push-in watch crown mechanism of claim 18, wherein:

the release mechanism is configured to allow the watch crown to be released out of the watch case via the external guide features;

the release mechanism is free to rotate axially relative to the entire watch crown mechanism and to the watch stem;

the guide features of the release mechanism are angled to match the profile of the teeth of the watch crown and thereby interlock the watch crown and the release mechanism, thereby turning the watch crown to lock into the locking internal slots of the housing or to turn the watch crown to release into the releasing internal slots of the housing, and whereby the release mechanism is configured to allow the watch crown to move from the locking internal slots to the releasing internal slots of the housing, or vice versa.

20. The push-in watch crown mechanism of claim 19, wherein:

at one end of the housing there is a portion that has no internal slots, thereby providing a clearance region on which the guide knobs of the watch crown can ride, wherein the guide knobs are free to rotate axially about the watch stem.

21. A method of using the push-in watch crown mechanism of claim 20, comprising the steps of:

a. providing the push-in watch crown mechanism in the watch;

b. pushing the watch crown of the watch crown mechanism into the watch such that the guide knobs of the watch crown move to the locking internal slots of the housing, thereby latching or locking the watch crown into a hidden state inside the watch body whereby the watch crown is held substantially flush with the the watch body edge;

c. pressing the watch crown of the watch crown assembly, thereby causing the guide knobs of the watch crown to move from the locking internal slots to the releasing internal slots of the housing, whereby the watch crown is released from inside the watch body and made accessible outside the watch body edge.

22. A push-in watch crown mechanism in a watch, wherein the watch comprises a watch body comprising a watch body edge, and wherein the push-in watch mechanism comprises:

a watch crown;

a means by which the watch crown can be pushed inside the watch body and held substantially flush with the watch body edge; and a means by which the watch crown can be released from inside the watch body such that the watch crown is protruding outside of the watch body and accessible by a user;

wherein when the watch crown is pushed inside the watch body and held substantially flush with the watch body edge, the watch crown is substantially hidden from view and substantially smooth to the touch with respect to the watch body edge;

wherein the watch further comprises a watch movement and a watch stem;

wherein the push-in watch crown mechanism is provided in relation to the watch body edge, the watch movement, and the watch stem; and wherein the push-in watch crown mechanism comprises a watch crown assembly in combination with a crown latching member; and further wherein the watch crown assembly comprises a watch crown, a housing, a collar, and a spring.

23. The push-in watch crown mechanism of claim 22, wherein a substantially continuous slot is provided in ring-fashion around the inner surface of the housing, wherein the slot is configured to receive and guide guide knobs of the watch crown.

24. The push-in watch crown mechanism of claim 23, wherein the slot is configured to receive and guide the guide knobs of the watch crown through a locking and releasing cycle wherein:

a. the guide knobs slide into an entry/exit portion of the slot;

b. the guide knobs slide into a locking portion of the slot, wherein when the guide knobs are in the locking portion, the watch crown is in the hidden or pushed-in state;

c. the guide knobs slide into a releasing portion of the slot; and d. the guide knobs slide out of the entry/exit portion of the slot.

25. The push-in watch crown mechanism of claim 24, configured such that each time a user pushes the watch crown, the guide knobs of the watch crown walk around the slot and the watch crown alternates between locked and released, and further wherein curves in the slot facilitate the movement of the guide knobs along the slot.

26. The push-in watch crown mechanism of claim 25, wherein at one end of the housing there is a portion that is free of the slot, thereby providing a clearance region on which the guide knobs of the watch crown can ride, wherein the guide knobs are free to rotate axially about the watch stem.

* * * * *